US005217558A

United States Patent [19]

Piampiani et al.

[11] Patent Number: 5,217,558

[45] Date of Patent: Jun. 8, 1993

[54] TRANSFER MOLDING ONTO REPTILE SKIN

[76] Inventors: Claudio Piampiani, 34, via Principe di, Piemonte, Civitanova Marche (Macerata); Guido Vitali, 19, via Cavallotti, Montegranaro (Ascoli Piceno), both of Italy

[21] Appl. No.: 607,160

[22] Filed: Oct. 31, 1990

[30] Foreign Application Priority Data

May 8, 1990 [IT] Italy ..... 3491 A/90

[51] Int. Cl.[5] ..... D06P 1/00; C14C 1/00

[52] U.S. Cl. ..... 156/277; 8/94.12; 8/467; 8/471

[58] Field of Search ..... 156/277; 8/436, 471, 8/467, 94.12

[56] References Cited

U.S. PATENT DOCUMENTS 4,892,556 1/1990 Schulzen ..... 8/436

FOREIGN PATENT DOCUMENTS 0226818 7/1987 European Pat. Off. .
3332571 3/1985 Fed. Rep. of Germany .
2757630 6/1989 Fed. Rep. of Germany .
2079922 11/1971 France .
2123073 9/1972 France .

*Primary Examiner*—David A. Simmons
*Assistant Examiner*—J. Sells
*Attorney, Agent, or Firm*—McAulay Fisher Nissen Goldberg & Kiel

[57] ABSTRACT

A method of transfer molding of inks onto a reptile skin wherein the tanned reptile skin is printing directly thereon in one or two passages with a transfer machine by using sublimatic inks to form a drawing and then to transfer print onto a bottom colored in advance; the same bottom can be previously colored in different way, by immersion, atomization or smearing, and after the transfer molding is carried out, a fixing treatment is made in order to protect the drawings from the atmospheric agents, which can be carried out through atomization by means of casein products and then the treatment is completed by lustering, and the bottom can be fitted with an adhesive film, or other bonding material in order to protect the printed bottom with a transparent one which maintains its visualization and provides a glossy surface with a hot color effect.

15 Claims, No Drawings

TRANSFER MOLDING ONTO REPTILE SKIN

BACKGROUND OF THE INVENTION

I. Field of the Invention

This invention is concerned with a transfer molding of inks onto a reptile skin.

More particularly, the present invention is concerned with the transfer of ink onto a reptile skin without the necessary pre-preparation treatments so that direct printing can take place on the reptile skin.

II. Description of the Prior Art

Reference is made to a U.S. Patent Application in the name of Guido Vitali, et al, which is based upon Italian Patent Application No. 3710A/89, filed Nov. 17, 1989, which is concerned with the transfer molding of ink onto skin, and the disclosure thereof is incorporated herein by reference.

In accordance with the prior art, the transfer printing onto reptile skin generally requires a preliminary water repellent treatment of the reptile skins as the reptile skins have a mixed conformation which includes a non-porous part which does not filter and generally has a horny base and a cartilage part which is porous. Therefore, when a water process is used in the transfer molding of drawings with present inks directly on the reptile skin, and without water repellent treatments, the printing effect varies in accordance with the penetration of ink into the cartilage or porous parts. The ink absorption into the cartilage or porous parts leads to a quick or rapid degradation of the skin.

SUMMARY OF THE INVENTION

The invention proposes to transfer the ink onto the reptile skin while avoiding the use of the water process and the water repellent treatment.

In accordance with the invention, drawings are used to transfer the ink onto the reptile skin. The ink and figure or drawing which is to be transferred to the reptile skin is first placed onto sublimatic paper. Sublimatic paper is paper which is capable of supporting ink. Sublimatic inks are also used, and this is an ink which transfers onto itself directly from the solid state to a gaseous state without the intermediate phase of the liquid state. The sublimatic inks generally filter into the porous part and the cartilage part since sublimatic inks generally have good penetrating possibilities and they quite effectively and efficaciously mix with the natural water repellent characteristics of the reptile skin. Transfer molding is carried out by applying the drawing from the sublimatic paper directly onto the reptile skin. If in fact different colors are required, the reptile skin can be and is first colored and then the drawing on the sublimatic paper is transferred onto the reptile skin.

To provide particular differentiations of dramatic and chromatic effects, such as bottoms or sides with different colorations, the bottom or sides of the reptile skin can be colored before the printing by conventional immersion in a tank, atomization or smearing onto the reptile skin.

After the reptile skin bottom is treated, and after the transfer molding is effected to the reptile skin, finish treatings or treatments take place. The finish treatments generally consist of a first fixing operation which can be carried out and includes the atomization by means of casein products to protect the printing from atmospheric agents and from any rubbing or abrasion; and then a lustering treatment is applied by mechanical means. The reptile skin bottom can be fixed with a transparent film by employing adhesives or glues to carry out the fixing. This enables or results in an increase in the thickness and the structural consistency of the resulting material since its two components act together. When the two components act together, they are stabilized together, while maintaining the reptile skin soft.

The properties of keeping the reptile skin soft while having the imprinting thereon is very important in the dress industry and particularly in the shoe manufacturing industry. Furthermore, the material consists of two plate components. The lower plate component is generally non-transparent and colored, and the upper plate component is generally transparent. The bottom portion generally produces the perception of being opaque and provides an opaque optical perception, and top portion generally produces a glossy transparent effect with a changing color effect on the surface.

DESCRIPTION OF THE PREFERRED EMBODIMENT

In accordance with the invention, transfer molding onto reptile skin includes the steps in which the reptile tanning skin bottom is directly printed thereon by means of transfer machines, or technically equivalent means, by using drawings made of sublimatic inks. Sublimatic inks are used because they have good penetrating possibility in the cartilage or porous parts of the reptile skin and they are efficaciously contrasted with and differ from the natural water repellent characteristic of the reptile skin. After transfer molding, the bottom portion is then worked with finish treatments which includes applying a first fixing operation which can be carried out through atomization by means of casein products and then applying a lustering treatment by mechanical means.

To further enhance the product, a transparent film can be fitted onto the printed bottom by means of adhesive systems or glues. With this process, a particularly soft material on the inside is provided which at the same time acts as a stabilizer to keep the reptile skin strong, and these are properties very important for a product in the dress industry. Furthermore, good protection of the reptile skin is realized, and an opacity for optical perception is created on the bottom surface and a glossy perception with changing effects on the top surface.

The reptile skin bottom can be colored before the printing with a conventional immersion in a tank or atomization or smearing to provide different chromatic effects.

While tanning the reptile skin, printing thereon is directly operated in one or two passages with a transfer machine by employing sublimatic inks to form the drawing on the reptile skin. In order to carry out a transfer printing onto the bottom, the bottom is colored in advance, and the bottom can be colored in different ways, by immersion, by atomization or smearing. After the transfer molding is completed. a fixing treatment is carried out in order protect the drawings from atmospheric agents which can be carried out through atomization by means of casein products, and then the treatment is completed by applying a lustering to the skin by mechanical means. The bottom can be fitted with an adhesive film or with any other bonding means in order to protect the printed bottom with a transparent one to maintain the visualization and provide a glossy surface with hot color effect.

While there has been disclosed what is considered to be the preferred embodiments of the invention, various changes and modifications may be made therein without departing from the scope of the invention.

We claim:

1. A method of transfer molding of a drawing onto a reptile skin, comprising:

directly printing of a drawing with a sublimatic ink onto a reptile skin without intermediation of any separate anchoring and free of a water repellent treatment process preparation being applied thereto prior to printing of said drawing directly onto the reptile skin, said sublimatic ink in relation to a cartilage or porous part of the reptile skin having good penetrating possibilities for said sublimatic ink to penetrate into the reptile skin.

2. The method of claim 1, including applying the drawing with the sublimatic ink to the sublimatic paper prior to printing of the drawing onto the reptile skin.

3. The method of claim 1, including applying said drawing to a sublimatic paper and transferring the drawing from the sublimatic paper directly to the reptile skin free of the water repellent treatment being applied to the reptile skin, whereby said sublimatic ink applied to the reptile skin penetrates into the reptile skin.

4. The method of claim 3, including applying a coloring to an inner part of the reptile skin, free from any prior water repellent treatment and prior to transferring the drawing on the sublimatic paper.

5. The method of claim 4, including a first fixing operation using casein products to protect the printing from atmospheric agents.

6. The method of claim 5, including applying a lustering treatment to said reptile skin.

7. The method of claim 4, including fitting a transparent film onto the an outer surface of said reptile skin with adhesives.

8. The method of claim 2, in which a first mixing operation is carried out through atomization by means of casein products.

9. The method of claim 8, including fitting a transparent film onto the reptile skin to obtain an opaque optical perception on an inner surface of said reptile skin and a glossy perception having a changing effect on an outer top surface of said reptile skin.

10. The method of claim 9, including coloring at least one surface of the reptile skin prior to printing.

11. The method of claim 1, including coloring an outer surface of the reptile skin prior to printing 12. The method of claim 11, including immersing the reptile skin into a coloring tank having coloring material contained therein for imprinting onto the reptile skin by penetration of the coloring material into the reptile skin.

13. The method of claim 3, including applying a coloring to an inner part of the reptile skin prior to transferring the drawing directly to an outer part of the reptile skin.

14. The method of claim 2, in which a first fixing operation is carried out by means of a lustering treatment whereby to enhance the color effect of the finished colored reptile skin.

15. The method of claim 1, including applying a lustering treatment to the reptile skin.

* * * * *